US009022355B1

(12) United States Patent
Pigeon

(10) Patent No.: US 9,022,355 B1
(45) Date of Patent: May 5, 2015

(54) HYDRAULIC JACK ATTACHMENT

(71) Applicant: Bruce W. Pigeon, Garrison, ND (US)

(72) Inventor: Bruce W. Pigeon, Garrison, ND (US)

( * ) Notice: Subject to any disclaimer, the term of this patent is extended or adjusted under 35 U.S.C. 154(b) by 0 days.

(21) Appl. No.: 14/277,341

(22) Filed: May 14, 2014

(51) Int. Cl.

| | |
|---|---|
| ***B66F 13/00*** | (2006.01) |
| ***B66F 5/04*** | (2006.01) |
| ***B66F 3/36*** | (2006.01) |
| ***B66F 3/00*** | (2006.01) |
| ***B66F 3/25*** | (2006.01) |
| *B66F 3/30* | (2006.01) |

(52) U.S. Cl.
CPC ... *B66F 3/25* (2013.01); *B66F 5/04* (2013.01); *B66F 3/30* (2013.01)

(58) Field of Classification Search
CPC ..... B66F 13/00; B66F 3/00; B66F 3/30; B66F 3/24; B66F 3/36
USPC ... 254/1 B, 1, 93 H, 89 H, 93 L, 93 R, 93 HP, 254/133 R, 134
See application file for complete search history.

(56) References Cited

U.S. PATENT DOCUMENTS

| | | | | | |
|---|---|---|---|---|---|
| 2,529,292 | A | * | 11/1950 | Greenfield | 254/133 R |
| 4,486,004 | A | * | 12/1984 | Drewitz et al. | 254/2 B |
| 4,624,447 | A | | 11/1986 | Richmeier | |
| 4,870,789 | A | * | 10/1989 | Clark et al. | 52/126.6 |
| 5,520,360 | A | * | 5/1996 | Wensman | 248/354.5 |
| 5,789,687 | A | * | 8/1998 | Johnson | 84/387 A |
| 5,915,672 | A | * | 6/1999 | Dickey | 254/133 R |
| 6,948,702 | B1 | | 9/2005 | Nigro | |
| 7,878,482 | B2 | | 2/2011 | Hernandez, Jr. | |
| 8,132,788 | B2 | | 3/2012 | Realegeno-Amaya | |
| 8,398,056 | B1 | * | 3/2013 | Morrison | 254/93 H |
| 2007/0114500 | A1 | | 5/2007 | Hernandez, Jr. | |
| 2007/0200102 | A1 | | 8/2007 | Hernandez, Jr. | |
| 2012/0153245 | A1 | * | 6/2012 | Zloch et al. | 254/93 R |

* cited by examiner

*Primary Examiner* — Lee D Wilson
*Assistant Examiner* — Seahee Yoon
(74) *Attorney, Agent, or Firm* — Neustel Law Offices

(57) ABSTRACT

A hydraulic jack attachment for quickly and safely jacking up high clearance objects in an efficient manner. The hydraulic jack attachment generally includes a base support adapted to be positioned underneath an object to be lifted. The base support includes a footing which includes one or more wheels to aid in repositioning the base support. A linkage tube is interlocked with a lifting member and positioned within the base support. A hydraulic jack may be placed into a lower end of the base support via an access opening. When the hydraulic jack is lifted, it will force the linkage tube and lifting tube upwards. A lifting head positioned on the upper end of the lifting tube will press against and force the object upwardly to jack the object up.

14 Claims, 10 Drawing Sheets

HYDRAULIC JACK ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a jacking attachment and more specifically it relates to a hydraulic jack attachment for quickly and safely jacking up high clearance objects in an efficient manner.

2. Description of the Related Art

Any discussion of the related art throughout the specification should in no way be considered as an admission that such related art is widely known or forms part of common general knowledge in the field.

Hydraulic jacks are commonly used to raise up various objects, such as vehicles when changing a tire. Conventional hydraulic jacks are widely available and are often well-suited for raising up lower clearance objects such as the aforementioned vehicles or the like. However, the limited height of the conventional hydraulic jack is often prohibitive when attempting to jack up a higher clearance object, such as a farm field sprayer or other large farm equipment.

While such farm areas generally already have hydraulic jacks, they often require expensive lift apparatuses for raising up such high clearance objects. Alternatively, highly specialized high clearance jacks may be purchased which are expensive to own and maintain and difficult to operate.

Because of the inherent problems with the related art, there is a need for a new and improved hydraulic jack attachment for quickly and safely jacking up high clearance objects in an efficient manner.

BRIEF SUMMARY OF THE INVENTION

The invention generally relates to a hydraulic jack attachment which includes a base support adapted to be positioned underneath an object to be lifted. The base support includes a footing which includes one or more wheels to aid in repositioning the base support. A linkage tube is interlocked with a lifting member and positioned within the base support. A hydraulic jack may be placed into a lower end of the base support via an access opening. When the hydraulic jack is lifted, it will force the linkage tube and lifting tube upwards. A lifting head positioned on the upper end of the lifting tube will press against and force the object upwardly to jack the object up.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
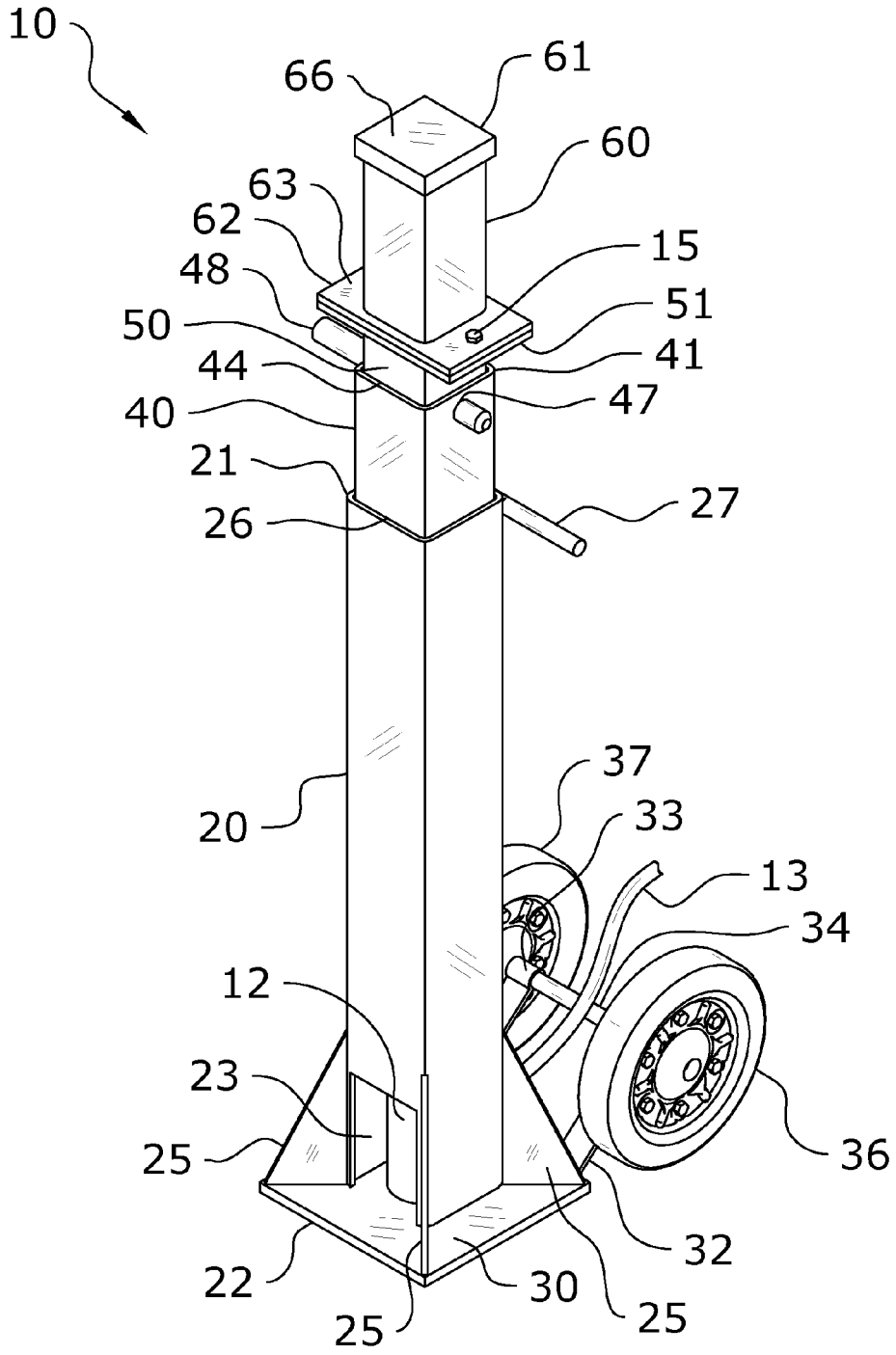
FIG. 1 is a frontal upper perspective view of the present invention.

Turning now descriptively to the drawings, in which similar reference characters denote similar elements throughout the several views, FIGS. 1 through 9 illustrate a hydraulic jack attachment 10, which comprises a base support 20 adapted to be positioned underneath an object to be lifted. The base support 20 includes a footing 30 which includes one or more wheels 36, 37 to aid in repositioning the base support 20. A linkage tube 40 is interlocked with a lifting member 50 and positioned within the base support 20. A hydraulic jack 12 may be placed into a lower end 22 of the base support 20 via an access opening 23. When the hydraulic jack 12 is lifted, it will force the linkage tube 40 and lifting tube 50 upwards. A lifting head 60 positioned on the upper end 51 of the lifting tube 50 will press against and force the object upwardly to jack the object up.

B. Base Support

As best shown in FIGS. 1-4, the present invention includes a base support 20 which is positioned on the ground and stores the hydraulic jack 12 used with the present invention. The other components of the present invention extend from the base support 20 as shown throughout the figures.

The base support 20 includes an upper end 21 and a lower end 22. The base support 20 may be comprised of various shapes, sizes, and configurations. Thus, the shape, size, and configuration of the exemplary base support 20 shown in the figures should not be construed as limiting on the scope of the present invention.

The base support 20 will preferably be elongated and hollow so as to accommodate the hydraulic jack 12. The base support 20 includes an access opening 23 adjacent to its lower end 22 through which the hydraulic jack 12 may be inserted into an inner channel 24. The inner channel 24 extends through the length of the base support 20. The hydraulic jack 12 will extend upwardly through the inner channel 24 when it is activated. The linkage tube 40 will also fit within the inner channel 24 as shown in the figures.

Figure 2:
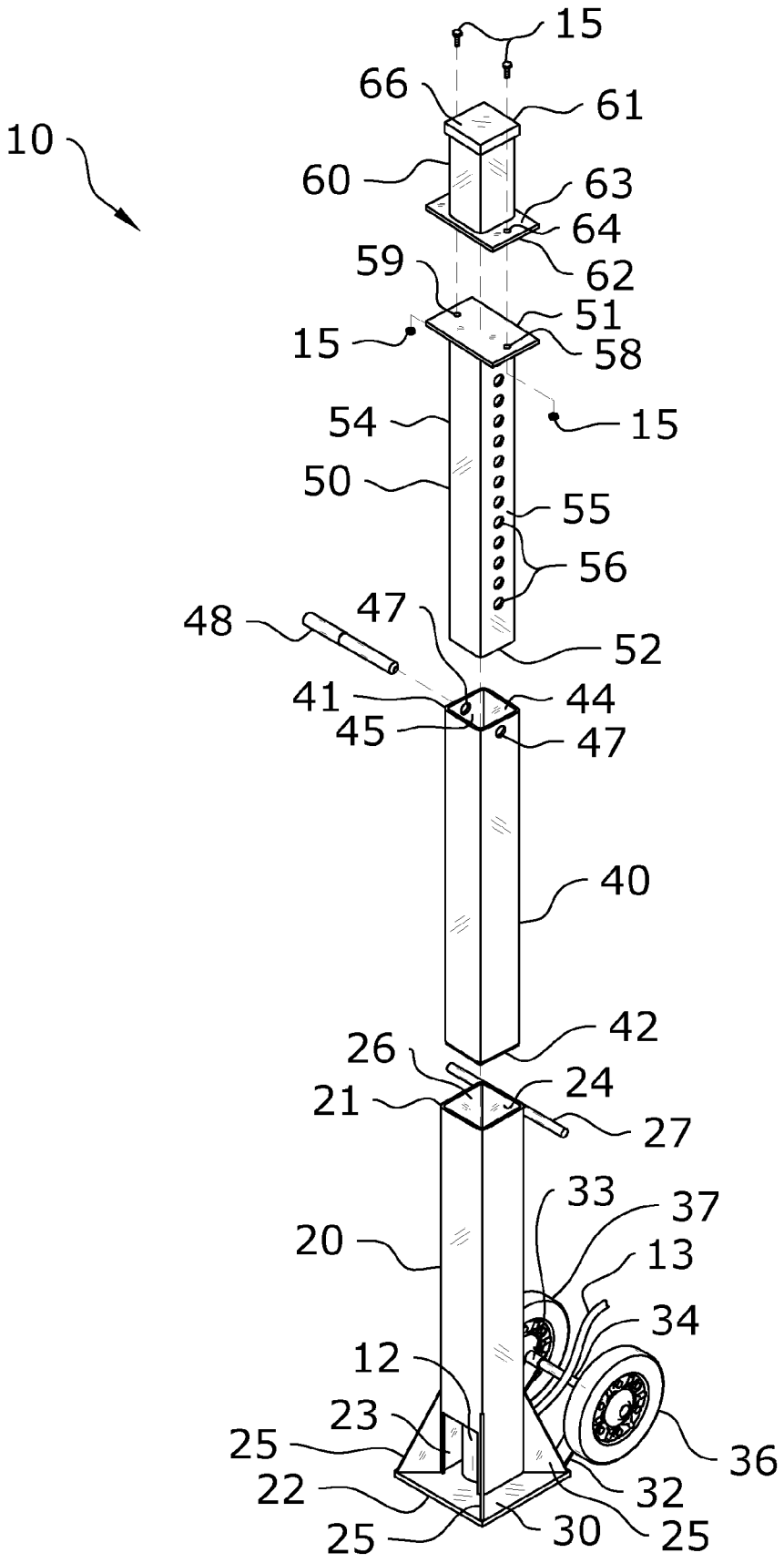
FIG. 2 is an exploded view of the present invention.
Figure 3:
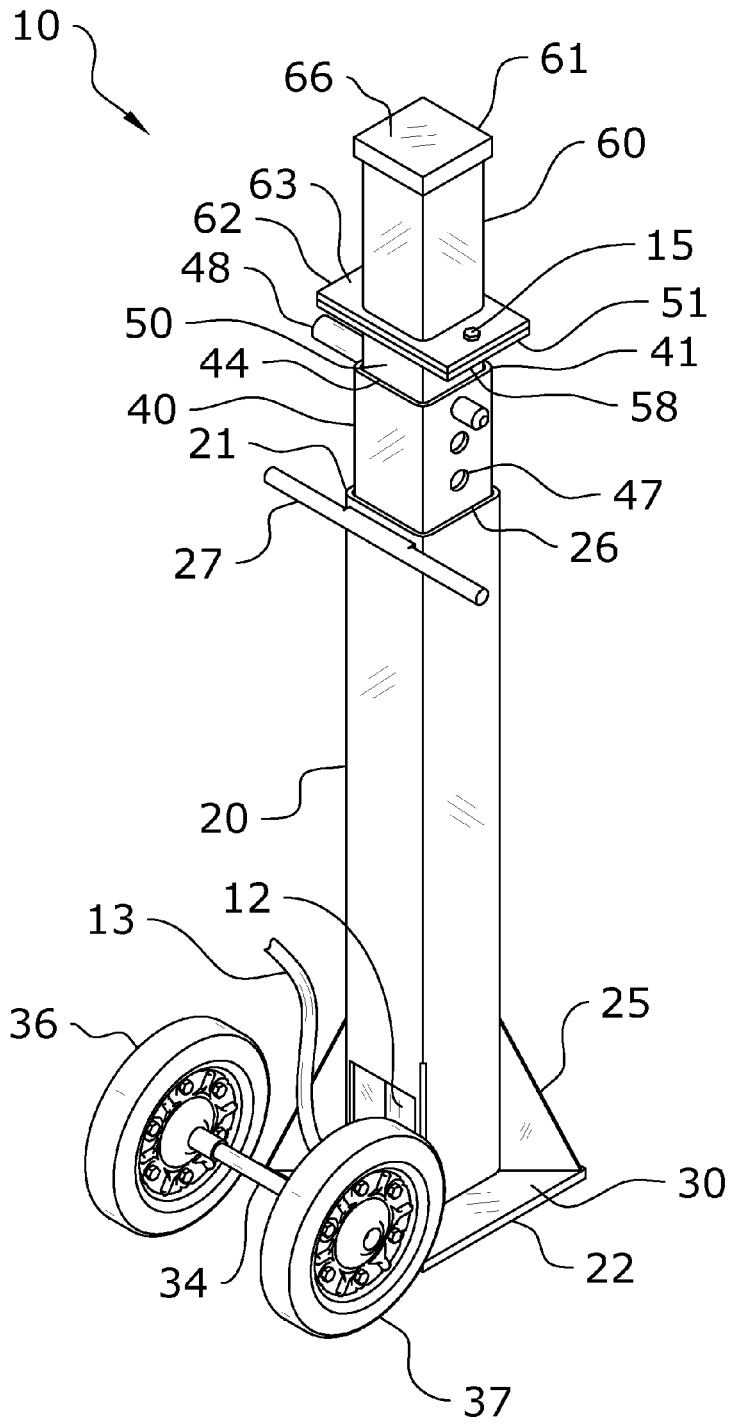
FIG. 3 is a rear upper perspective view of the present invention.
Figure 4:
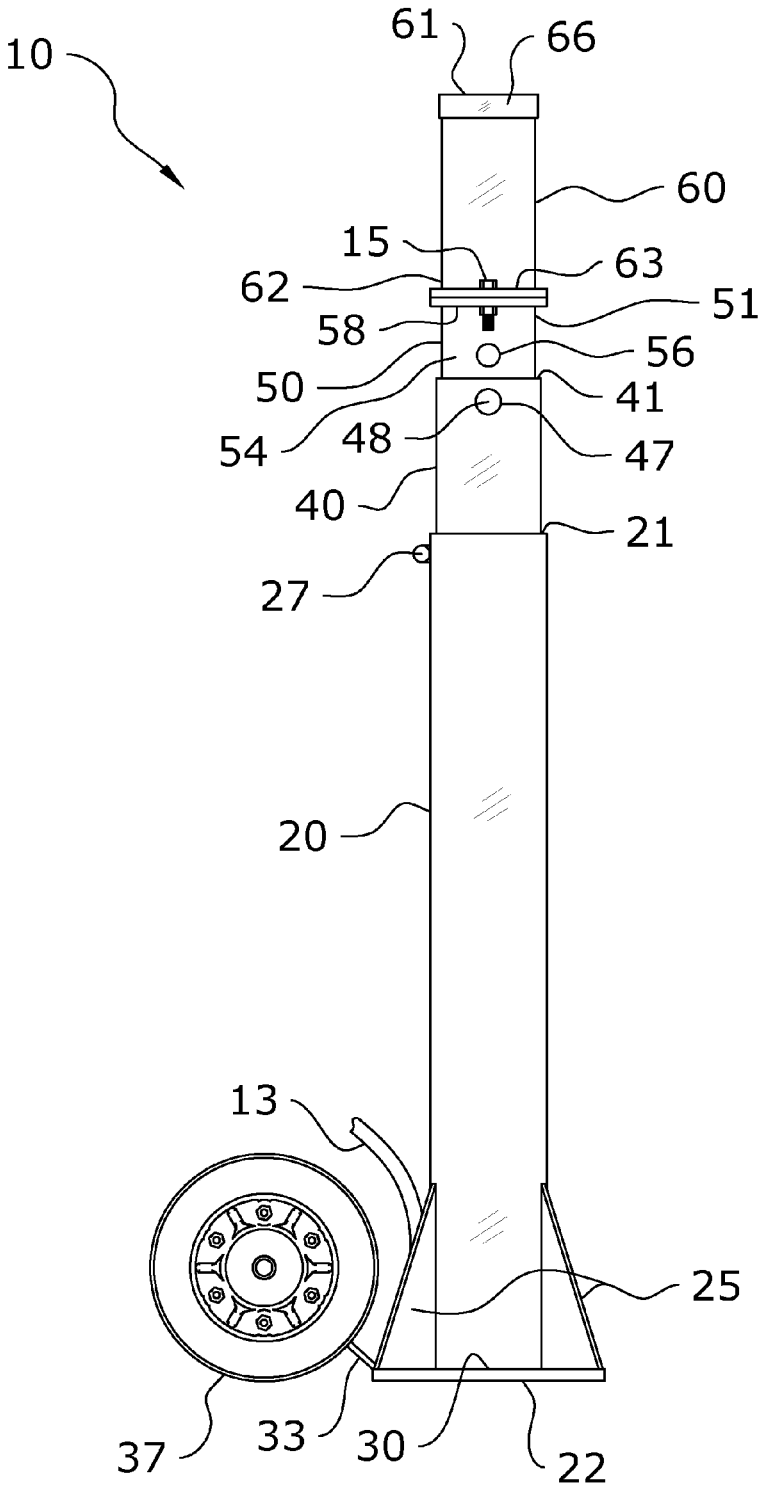
FIG. 4 is a side view of the present invention.
Figure 5:
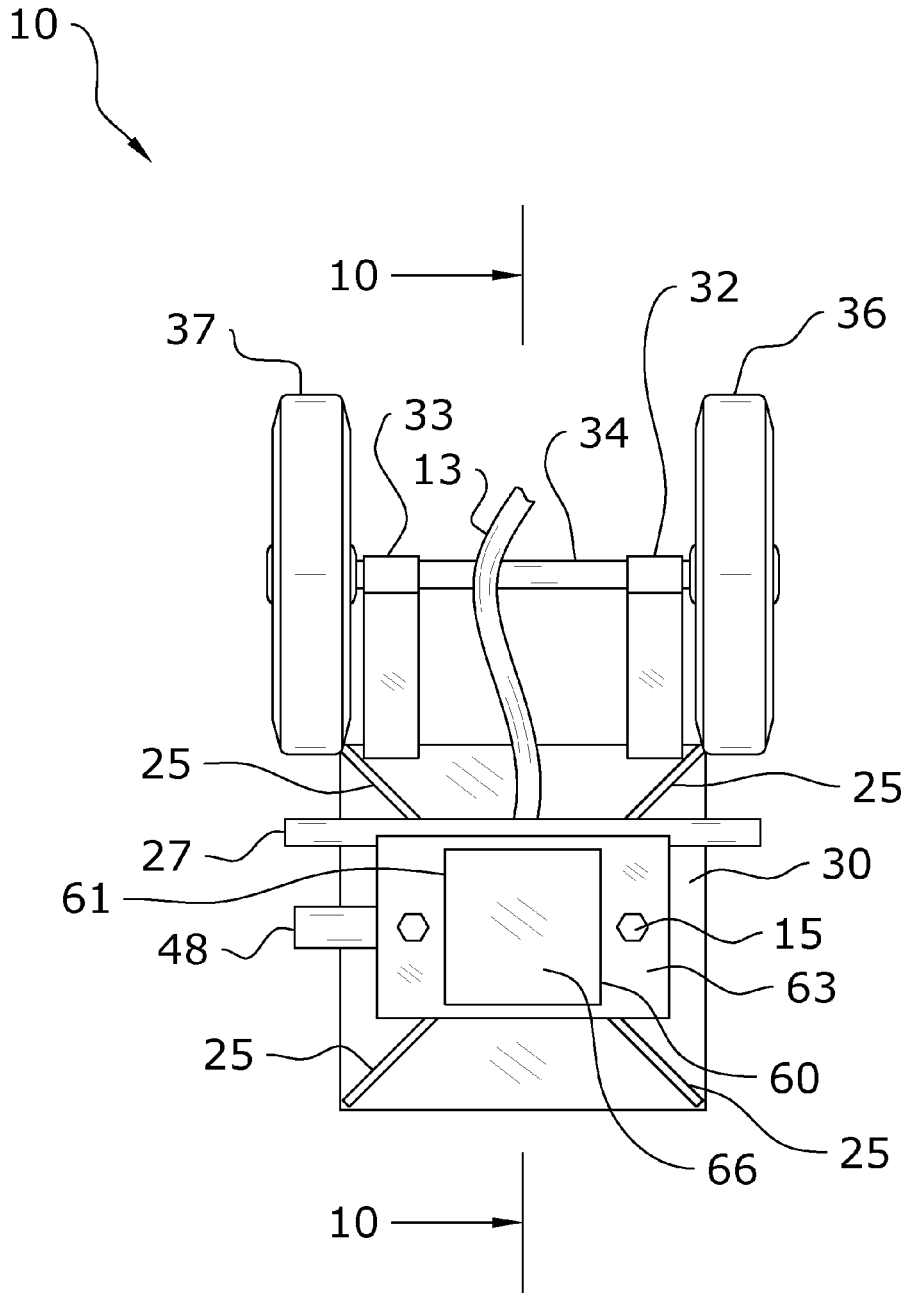
FIG. 5 is a top view of the present invention.

The upper end 21 of the base support 20 includes an upper opening 26 as shown in FIG. 2. The upper opening 26 leads to the inner channel 24. The linkage tube 40 of the present invention is generally inserted into the inner channel 24 through the upper opening 26 of the base support 20. The hydraulic jack 12 will push the linkage tube 40 and lifting member 50 up through the upper opening 26 when the present invention is in use.

The upper end 21 of the base support 20 may also include a handle 27 as shown in the figures. In a preferred embodiment, the handle 27 comprises a simple bar or rod which extends from both sides of the upper end 21 of the base support 20. However, various other handle 27 configurations may be utilized to aid in repositioning the base support 20.

The base support 20 includes a footing 30 at its lower end 22 which acts as a base for the base support 20 to keep it from tipping over. One or more gussets 25 may be positioned at or near the footing 30 for extra stability as shown in the figures. The gussets 25 generally are connected between the footing 30 and the base support 20 such as shown in FIG. 6.

The footing 30 includes a first wheel mount 32 extending from a first side thereof and a second wheel mount 33 extending from a second side thereof. The first wheel mount 32 includes a first wheel 36 and the second wheel mount 33 includes a second wheel 37. An axle 34 extends between the wheels 36, 37. The hydraulic line 13 of the hydraulic jack 12 may rest upon the axle 34 so as to act as a guide for the hydraulic line 13 as best shown in FIG. 2.

C. Linkage Tube

Figure 6:
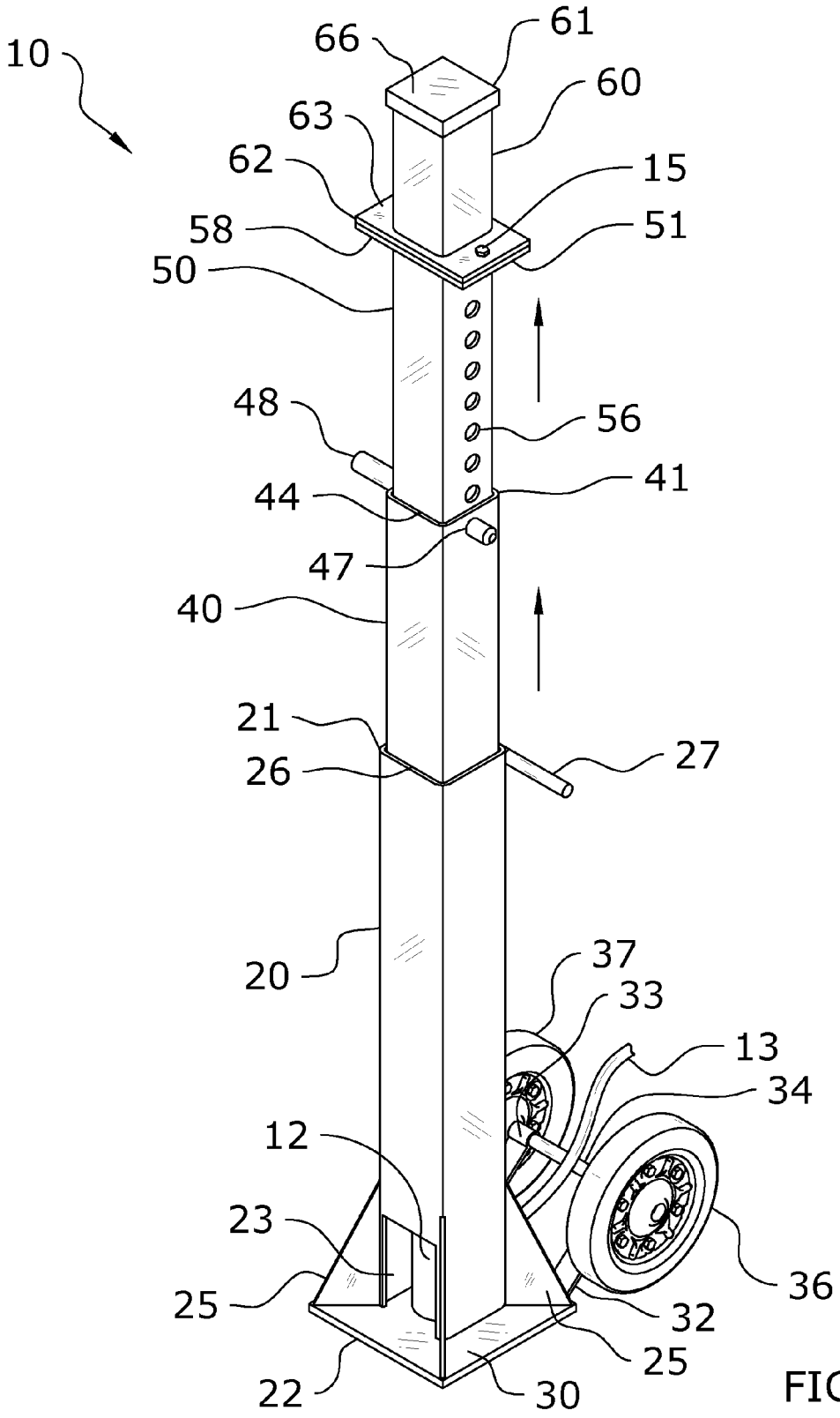
FIG. 6 is an upper perspective view of the present invention with an elongated effective length.

As best shown in FIG. 6, the present invention includes a linkage tube 40 which is slidably positioned within the inner channel 24 of the base support 20, such as through its upper opening 26. The linkage tube 40 may be comprised of various configurations, shapes, and sizes. In a preferred embodiment as shown in the figures, the linkage tube 40 comprises an elongated, hollow member having an upper end 41 and a lower end 42.

The upper end 41 of the linkage tube 40 includes an upper opening 44 leading to an inner channel 45. The inner channel 45 extends for the length of the linkage tube 40 between its upper end 41 and its lower end 42. However, the lower end 42 of the linkage tube 40 is preferably closed so that it may be forced upwardly by the hydraulic jack 12 when the present invention is in use.

The upper end 41 of the linkage tube 40 may include one or more locking apertures 47 which are utilized to secure the lifting member 50 within the linkage tube 40. The locking apertures 47 will be utilized with a locking pin 48 which is selectively inserted through both the locking apertures 47 of the linkage tube 40 and one of the locking apertures 56 of the lifting member 50 to adjust the effective length of the present invention so that it may be adapted for different applications.

It should be appreciated that the locking apertures 47 of the linkage tube 40 may be positioned at locations other than the upper end 41 of the linkage tube 40. It should also be appreciated that the linkage tube 40 could include more locking apertures 47 than shown in the figures, such as a line of locking apertures 47 extending for all of or part of the linkage tube's 40 length.

D. Lifting Member

Figure 7:
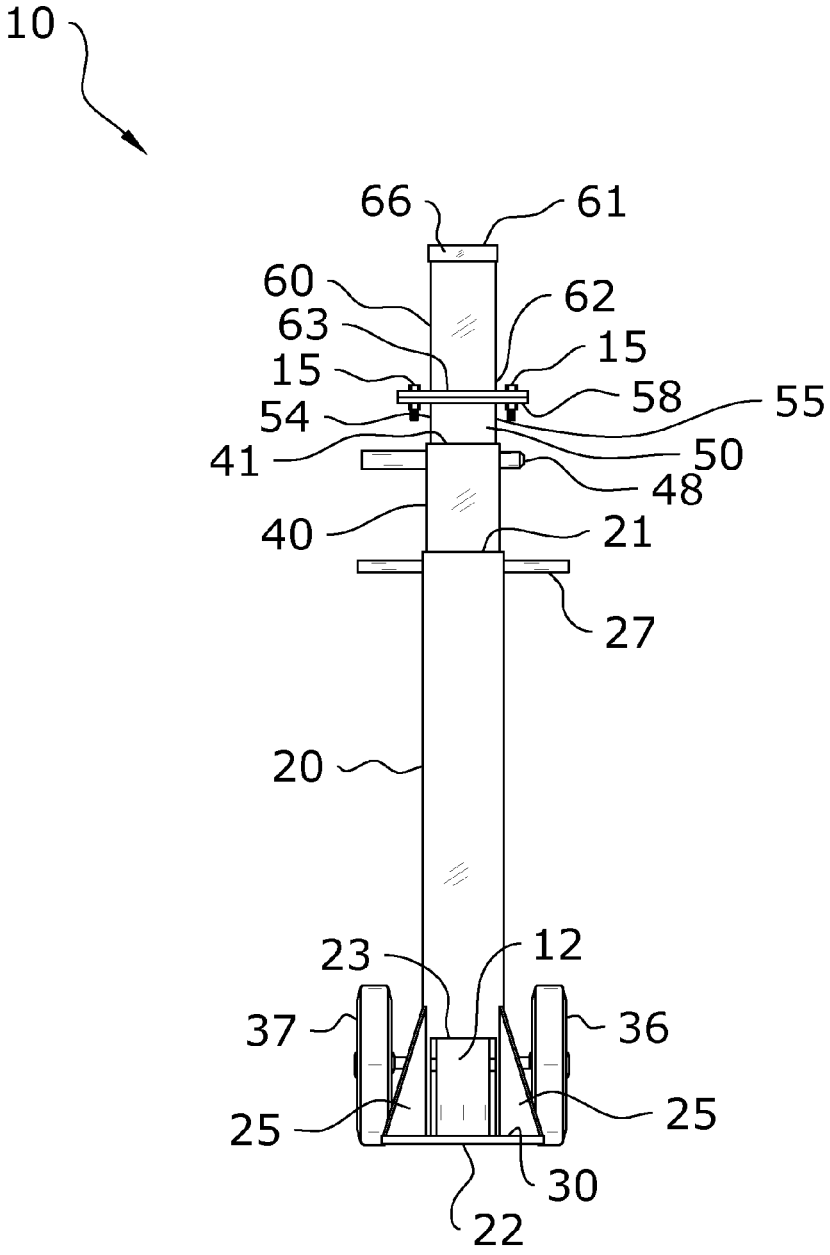
FIG. 7 is a frontal view of the present invention.
Figure 8:
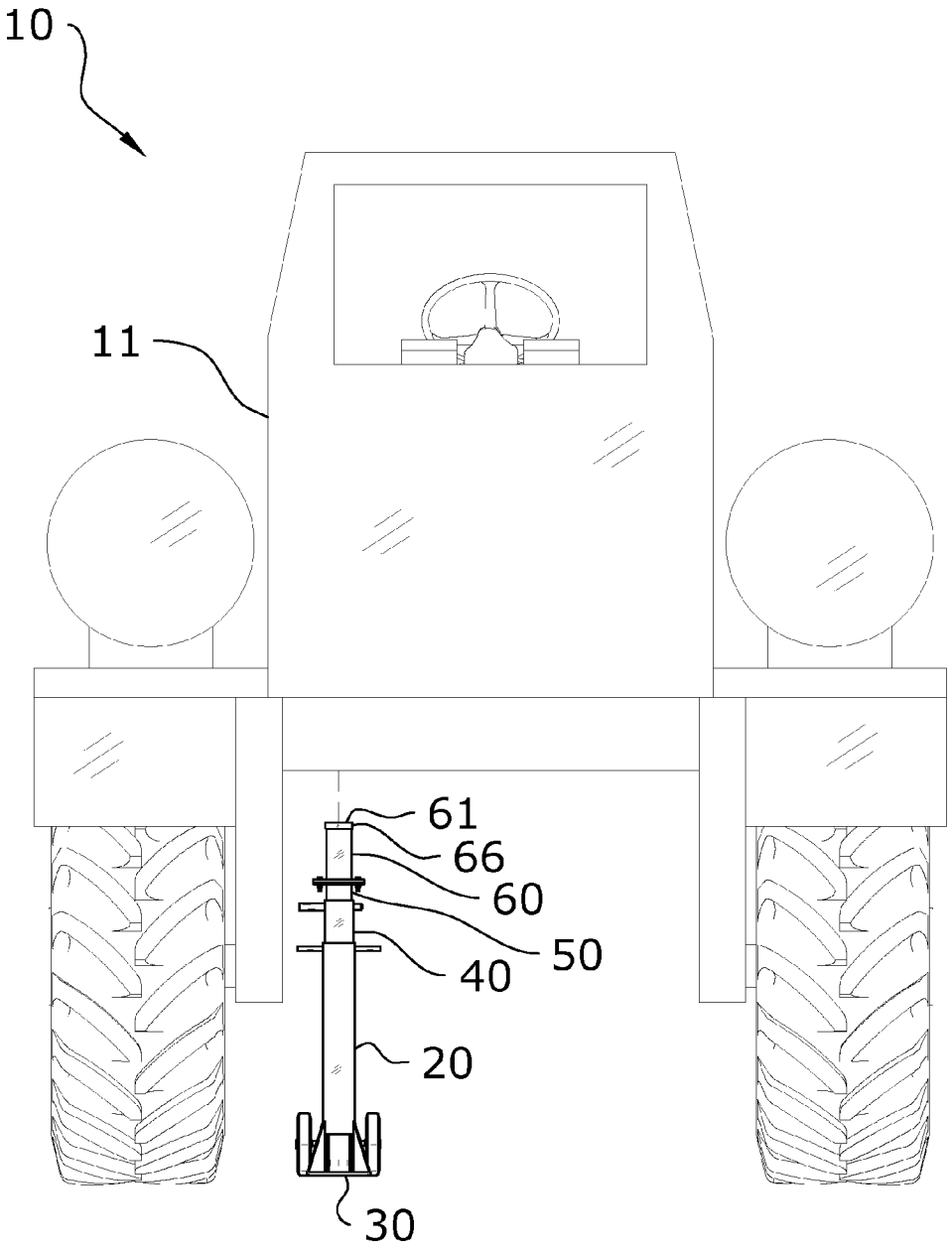
FIG. 8 is a frontal view illustrating the present invention positioned underneath an object to be lifted.
Figure 9:
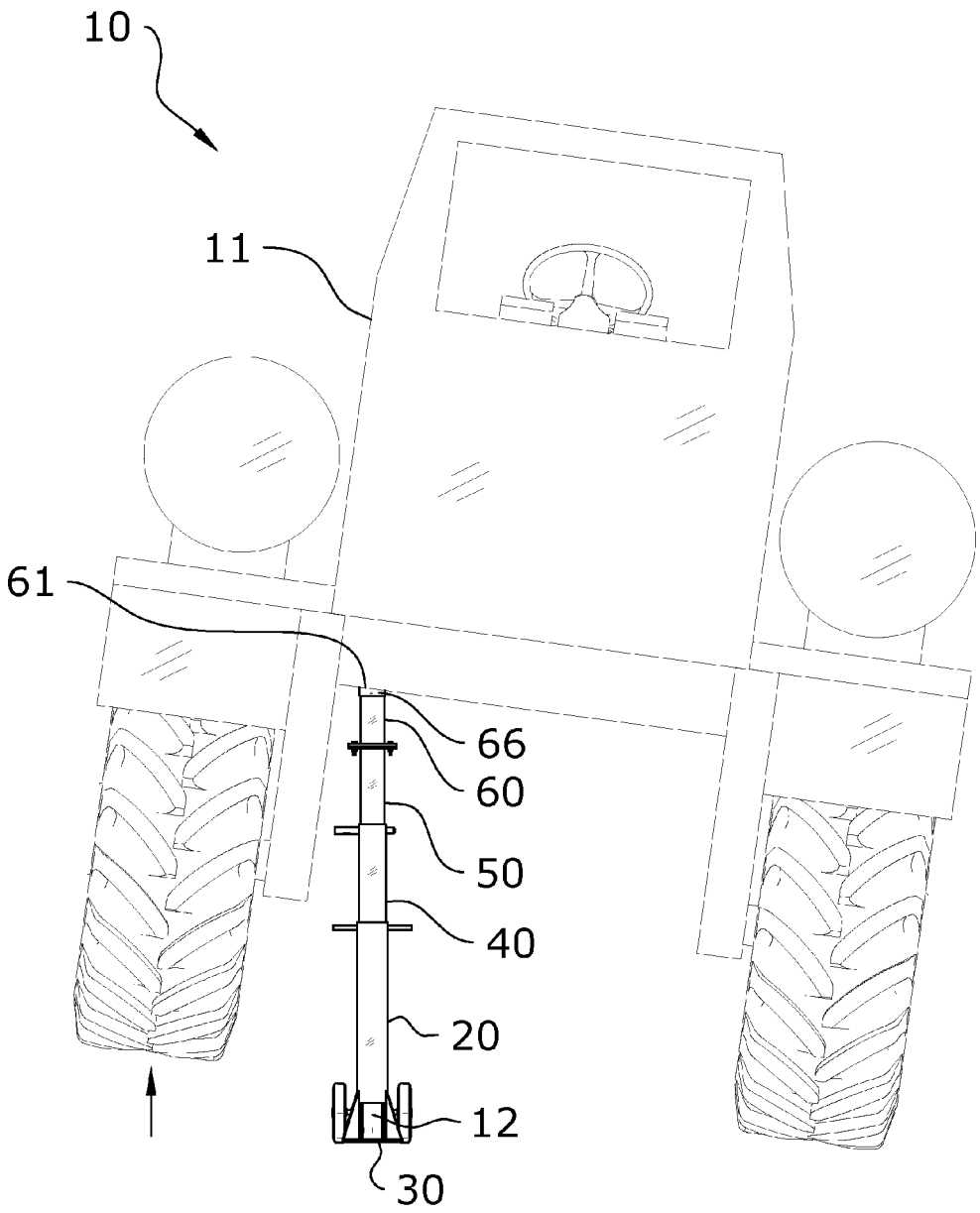
FIG. 9 is a frontal view illustrating an object being lifted by the present invention.
Figure 10:
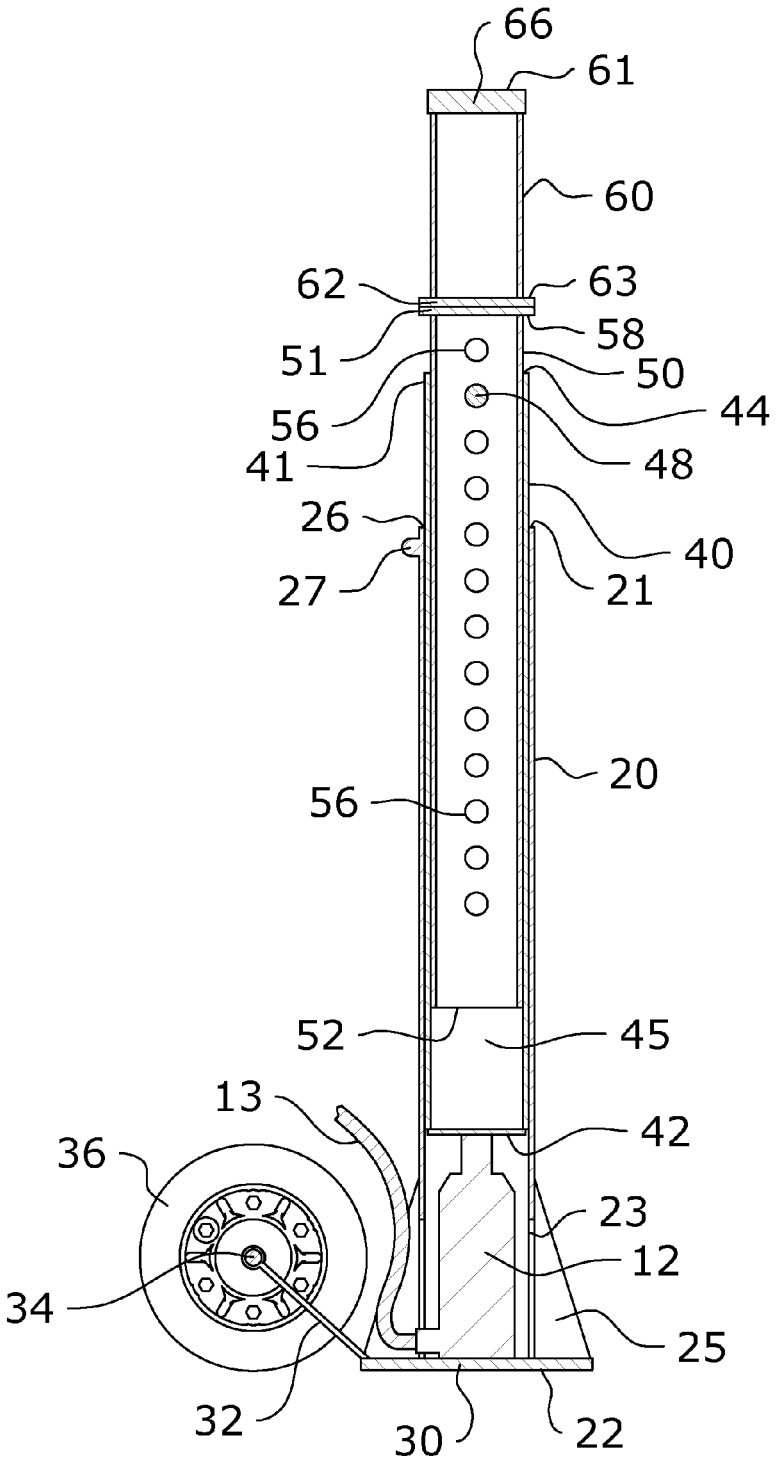
FIG. 10 is a side sectional view of the present invention.

As shown in FIGS. 7-8, a lifting member 50 is utilized which acts to lift an object to be jacked up by the present invention. The lifting member 50 is adjustably secured to the linkage tube 40 in a manner which allows the effective length of the present invention to be adjusted for different purposes. The lifting member 50 generally fits within the linkage tube 40 and then is locked in place via usage of the locking apertures 47 of the linkage tube 40, the locking apertures 56 of the lifting member 50, and the locking pin 48.

The lifting member 50 is generally comprised of an elongated member having an upper end 51 and a lower end 52. The lifting member 50 may be comprised of various shapes, sizes, and configurations. In general, the lifting member 50 will be a slightly smaller diameter than the linkage tube 40 but the same overall shape and configuration so that the lifting member 50 fits within the linkage tube 40 as shown in the figures.

The lifting member 50 includes a plurality of locking apertures 56 extending through the lifting member 50 between its first side 54 and its second side 55. The locking apertures 56 will generally extend along the length of the lifting member 50 as best shown in FIG. 2. The locking apertures 56 of the lifting member 50 are aligned with the locking apertures 47 of the linkage tube 40 to selectively adjust the overall effective length of the present invention and thus adjust the height to which an object is being jacked up with the present invention.

The upper end 51 of the lifting member 50 includes an attachment plate 58 which is adapted to receive and secure a lifting head 60 to the lifting member 50. The attachment plate 58 is a plate member which is either secured to or integrally formed with the upper end 51 of the lifting member 50 as shown in the figures. The attachment plate 58 may include one or more attachment apertures 59 for securing the lifting head 60 to the attachment plate 58, such as with fasteners 15. In other embodiments, the lifting head 60 may be integrally formed with the upper end 51 of the lifting member 50 and an attachment plate 58 may be omitted.

As best shown in FIG. 6, the lifting head 60 comprises an elongated member having an upper end 61 and a lower end 62. The lower end 62 of the lifting head 60 includes a base plate 63 which may include one or more base apertures 64 adapted to fastened to the attachment apertures 59 such as via fasteners 15. The upper end 61 of the lifting head 60 may include a cushion portion 66 which is comprised of a soft or malleable material to prevent damage to the object being lifted from contact with the lifting head 60.

E. Operation of Preferred Embodiment

In use, the effective length of the present invention is first set by adjusting the lifting member 50 within the linkage tube 40, aligning the respective apertures 47, 56, and using the locking pin 48 to secure the lifting member 50 and linkage tube 40 to each other. If needed, the lifting head 60 may be secured to the attachment plate 58 of the lifting member 50 via fasteners 15.

The present invention may then be positioned in place underneath the object to be lifted. The present invention may be grasped by its handle 27, tilted, and rolled using its wheels 36, 37 to the proper location. Once so positioned under the object, the hydraulic jack 12 may be placed into the inner channel 24 of the base support 20 via the access opening 23. The hydraulic line 13 leading from the hydraulic jack 12 may be passed over the axle 34 to guide the line 13 as it exits the base support 20.

The hydraulic jack 12 may then be activated to lift up the object under which the present invention is positioned. The hydraulic jack 12 will push the linkage tube 40 upwards within the inner channel 24 of the base support 20. This will also cause the lifting member 50 to move upwardly, causing the lifting head 60 to contact the underside of the object and thus jack up the object to a raised height.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hydraulic jack attachment, comprising:

a base support including a footing, wherein said base support comprises an elongated, hollow member, wherein said base support includes an access opening leading to an inner channel;

a linkage tube positioned within said inner channel of said base support;

a lifting member adjustably connected to said linkage tube, wherein said base support is adapted to receive a hydraulic jack within said inner channel via said access opening and wherein said linkage tube is adapted to be lifted or lowered by said hydraulic jack, wherein said lifting member includes an attachment plate; and a lifting head removably connected to an upper end of said lifting member, wherein said lifting head includes a base plate, wherein said base plate of said lifting head is removably connected to said attachment plate of said lifting member.

2. The hydraulic jack attachment of claim 1, further comprising one or more gussets connected between said footing and said base support.

3. The hydraulic jack attachment of claim 1, further comprising a pair of wheels extending from said footing.

4. The hydraulic jack attachment of claim 3, further comprising a handle positioned at an upper end of said base support.

5. The hydraulic jack attachment of claim 1, wherein said lifting member includes a plurality of attachment apertures extending along a length of said lifting member.

6. The hydraulic jack attachment of claim 5, wherein said linkage tube includes locking apertures positioned adjacent to an upper end of said linkage tube, said locking apertures being adapted to align with one of said attachment apertures for connecting said linkage tube with said lifting member.

7. The hydraulic jack attachment of claim 1, wherein said lifting head includes a cushion portion.

8. A hydraulic jack attachment system, comprising:

a base support including a footing, wherein said base support comprises an elongated, hollow member, wherein said base support includes an access opening leading to an inner channel;

a hydraulic jack positioned within said inner channel of said base support;

a linkage tube positioned within said inner channel of said base support above said hydraulic jack;

a lifting member adjustably connected to said linkage tube, wherein said linkage tube is adapted to be lifted or lowered by said hydraulic jack lifting or lowering said linkage tube, wherein said lifting member includes an attachment plate; and a lifting head removably connected to an upper end of said lifting member, wherein said lifting head includes a base plate, wherein said base plate of said lifting head is removably connected to said attachment plate of said lifting member.

9. The hydraulic jack attachment of claim 8, further comprising one or more gussets connected between said footing and said base support.

10. The hydraulic jack attachment of claim 8, further comprising a pair of wheels extending from said footing.

11. The hydraulic jack attachment of claim 10, further comprising a handle positioned at an upper end of said base support.

12. The hydraulic jack attachment of claim 8, wherein said lifting member includes a plurality of attachment apertures extending along a length of said lifting member.

13. The hydraulic jack attachment of claim 12, wherein said linkage tube includes locking apertures positioned adjacent to an upper end of said linkage tube, said locking apertures being adapted to align with one of said attachment apertures for connecting said linkage tube with said lifting member.

14. The hydraulic jack attachment of claim 8, wherein said lifting head includes a cushion portion.

* * * * *